US012778231B2

(12) United States Patent
Contreras

(10) Patent No.: US 12,778,231 B2
(45) Date of Patent: Nov. 3, 2026

(54) DEVICE FOR AFFIXING AN ORNAMENTAL PIECE HAVING REPLACEABLE ELEMENTS

(71) Applicant: Michael Contreras, Alhambra, CA (US)

(72) Inventor: Michael Contreras, Alhambra, CA (US)

( * ) Notice: Subject to any disclaimer, the term of this patent is extended or adjusted under 35 U.S.C. 154(b) by 239 days.

(21) Appl. No.: 18/390,063

(22) Filed: Dec. 20, 2023

(65) Prior Publication Data

US 2024/0215673 A1 Jul. 4, 2024

Related U.S. Application Data

(60) Provisional application No. 63/477,830, filed on Dec. 30, 2022.

(51) Int. Cl.
*A42B 1/248* (2021.01)
*A44B 17/00* (2006.01)

(52) U.S. Cl.
CPC ..... *A42B 1/248* (2013.01); *A44B 17/0023* (2013.01); *A44B 17/0029* (2013.01); *A44B 17/0041* (2013.01)

(58) Field of Classification Search
CPC . A42B 1/248; A44B 17/0023; A44B 17/0029; A44B 17/0041
USPC ..... 40/329
See application file for complete search history.

(56) References Cited

U.S. PATENT DOCUMENTS 8,522,403 B2 * 9/2013 Hayashi ..... A44B 1/34 24/104
9,955,744 B1 * 5/2018 Yanes ..... A42B 1/248
10,470,531 B1 * 11/2019 Yanes ..... A44C 1/00
2004/0154140 A1 * 8/2004 Cho ..... A44B 1/30 24/114.05
2007/0022514 A1 * 2/2007 Paulson ..... A42B 1/248 2/171
2008/0022439 A1 * 1/2008 Cho ..... A44B 1/12 24/90.1
2014/0325797 A1 * 11/2014 Hasegawa ..... A44B 17/0052 24/108
2016/0302533 A1 * 10/2016 Oakley ..... A63F 9/10
2020/0329799 A1 * 10/2020 Morrone ..... A42B 1/248

FOREIGN PATENT DOCUMENTS

FR 434041 A * 1/1912
JP 02271805 A * 11/1990
KR 20180006720 A * 1/2018 ..... A42B 1/004
WO WO-2005121474 A1 * 12/2005 ..... E04F 13/0841

OTHER PUBLICATIONS

JP02271805A English Translation (Year: 1990).*

* cited by examiner

*Primary Examiner* — Kyle R Grabowski
(74) *Attorney, Agent, or Firm* — Robinson IP Law, PLLC

(57) ABSTRACT

Various implementations include a device for affixing an ornamental piece. The device includes a fixed portion and a replaceable portion. The fixed portion is attached to a portion of an object. The fixed portion includes a base and one of a male portion including a projection or a female portion defining an interior portion. The replaceable portion includes an other of the female portion defining the interior portion or the male portion including the projection. The interior portion of the female portion is shaped to receive the projection of the male portion to removably couple the replaceable portion to the male portion.

20 Claims, 9 Drawing Sheets

DEVICE FOR AFFIXING AN ORNAMENTAL PIECE HAVING REPLACEABLE ELEMENTS

FIELD

This disclosure relates to the field of affixing an ornamental piece to another object such as headwear. More particularly, this disclosure relates to an emblem or other element that is removably attached to headwear.

BACKGROUND

Headwear, such as baseball hats and caps, frequently include an emblem or other decorative element sewn or stitched onto the hat. For example, hats may include a logo or emblem of a sports team, company, or other logo on a front of the hat. Existing methods of securing the logo or emblem onto headwear includes sewing the logo or emblem or otherwise attaching a patch to the headwear. Existing methods of adding logos, emblems, or other decorative elements to headwear are substantially permanent and do not permit ready removal of the logos, emblems, or other decorative elements from the headwear.

It may be desirable for an individual to be able to place different logos or decorative elements onto headwear. For example, an individual may desire to wear different logos for different events, or to change a style of the headwear. Currently an individual must purchase different hats with different logos or emblems on each of the different hats. Customization of individual pieces of headwear is difficult or impossible because once logos or other decorative elements are located on a piece of headwear it is not possible to remove the logo or decorative elements to be replaced with a different element.

What is needed, therefore, is headwear featuring a removable element such that a wearer of the headwear may readily customize and enhance the appearance of the headwear.

SUMMARY

Various implementations include a device for affixing an ornamental piece. The object includes a fixed portion and a replaceable portion. The fixed portion is attached to a portion of the object. The fixed portion includes a base and one of a male portion including a projection or a female portion defining an interior portion. The replaceable portion includes an other of the female portion defining the interior portion or the male portion including the projection. The interior portion of the female portion is shaped to receive the projection of the male portion to removably couple the replaceable portion to the male portion.

In some implementations, the fixed portion includes a first orientation device and the replaceable portion includes a second orientation device. in some implementations, the first orientation device is configured to prevent rotational movement of the replaceable portion relative to the fixed portion when the replaceable portion is coupled to the fixed portion. In some implementations, one of the first orientation device and the second orientation device includes a protrusion and an other of the second orientation device and the first orientation device defines an indentation. In some implementations, the indentation is configured to receive the protrusion. In some implementations, the protrusion includes a collar extending circumferentially at least partially around the projection or the interior portion. In some implementations, the protrusion includes a distal flange and the indentation includes an indentation groove. In some implementations, the indentation groove is configured to receive the distal flange when the replaceable portion is coupled to the fixed portion.

In some implementations, the projection of the male portion includes a distal flared portion. In some implementations, the interior portion of the female portion defines a channel and an interior portion groove. In some implementations, the interior portion groove is configured to receive the flared portion when the replaceable portion is coupled to the fixed portion. In some implementations, the flared portion of the projection is sized to be a friction fit with the channel and the same or smaller sized than the interior portion groove to retain the replaceable portion when the replaceable portion is coupled to the fixed portion.

In some implementations, the fixed portion includes the male portion and the replaceable portion includes the female portion.

In some implementations, the base of the fixed portion defines a plurality of holes extending through the base. In some implementations, the plurality of holes are spaced apart from each other adjacent a perimetrical edge of the base.

In some implementations, the object is a hat.

In some implementations, the replaceable portion defines a recess for receiving the base of the fixed portion.

In some implementations, the base of the fixed portion includes a first surface for abutting the portion of the object and a second surface opposite and spaced apart from the first surface. In some implementations, the projection extends from the second surface. In some implementations, the first surface has a concave surface for conforming to the curvature of the portion of the object. In some implementations, the second surface has a convex surface substantially similar to the curvature of the object.

Various other implementations include a system for affixing an ornamental piece. The system includes a fixed portion, a first replaceable portion, and a second replaceable portion. The fixed portion is attached to a portion of an object. The fixed portion includes a base and one of a male portion including a projection or a female portion defining an interior portion. Each of the first replaceable portion and the second replaceable portion include the other of the female portion defining the interior portion or the male portion including the projection. The interior portion of the female portion is shaped to receive the projection of the male portion to removably couple the first replaceable portion or the second replaceable portion to the male portion.

In some implementations, the fixed portion includes a first orientation device and the first replaceable portion and the second replaceable portion each include a second orientation device. In some implementations, the first orientation device is configured to prevent rotational movement of the first replaceable portion or the second replaceable portion relative to the fixed portion when the first replaceable portion or the second replaceable portion. In some implementations, one of the first orientation device and the second orientation device includes a collar extending circumferentially at least partially around the projection or the interior portion and the other of the second orientation device and the first orientation device defines an indentation. In some implementations, the indentation is configured to receive the protrusion.

In some implementations, the projection of the male portion includes a distal flared portion. In some implementations, the interior portion of the female portion defines a channel and an interior portion groove. In some implementations, the interior portion groove is configured to receive the flared portion when the first replaceable portion or the second replaceable portion is coupled to the fixed portion. In some implementations, the flared portion of the projection is sized to be a friction fit with the channel and the same or smaller sized than the interior portion groove to retain the first replaceable portion or the second replaceable portion when the first replaceable portion or the second replaceable portion.

In some implementations, the fixed portion includes the male portion and the first replaceable portion or the second replaceable portion each include the female portion.

In some implementations, the base of the fixed portion defines a plurality of holes extending through the base.

BRIEF DESCRIPTION OF DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

Various implementations include a device for affixing an ornamental piece. The device includes a fixed portion and a replaceable portion. The fixed portion is attached to a portion of the object. The fixed portion includes a base and one of a male portion including a projection or a female portion defining an interior portion. The replaceable portion includes an other of the female portion defining the interior portion or the male portion including the projection. The interior portion of the female portion is shaped to receive the projection of the male portion to removably couple the replaceable portion to the male portion.

Various other implementations include a system for affixing an ornamental piece. The system includes a fixed portion, a first replaceable portion, and a second replaceable portion. The fixed portion is attached to a portion of an object. The fixed portion includes a base and one of a male portion including a projection or a female portion defining an interior portion. Each of the first replaceable portion and the second replaceable portion include the other of the female portion defining the interior portion or the male portion including the projection. The interior portion of the female portion is shaped to receive the projection of the male portion to removably couple the first replaceable portion or the second replaceable portion to the male portion.

Figure 1:
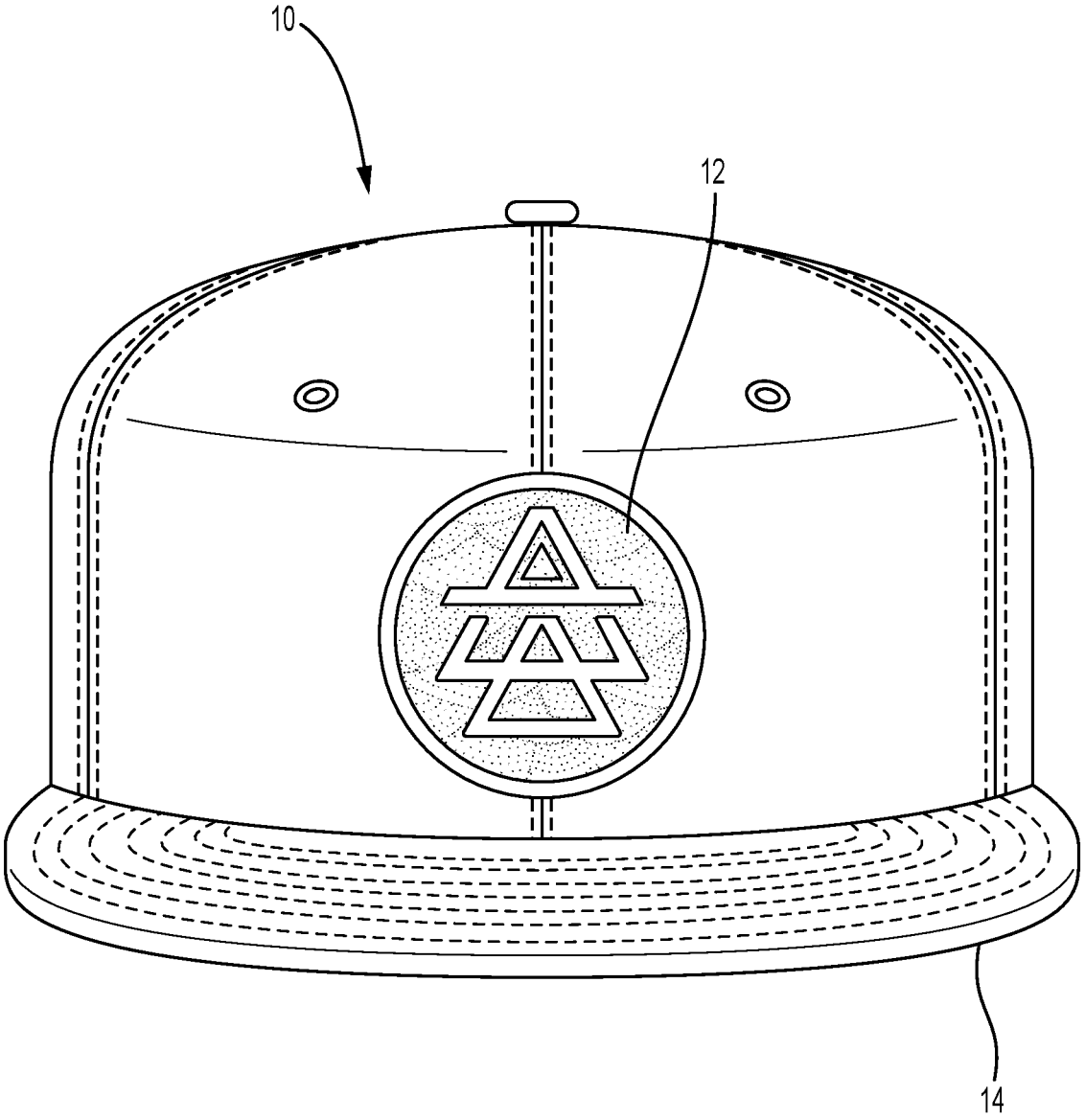
FIG. 1 shows a front view of a hat including a removable portion secured thereon according to one aspect of the present disclosure.
Figure 2:
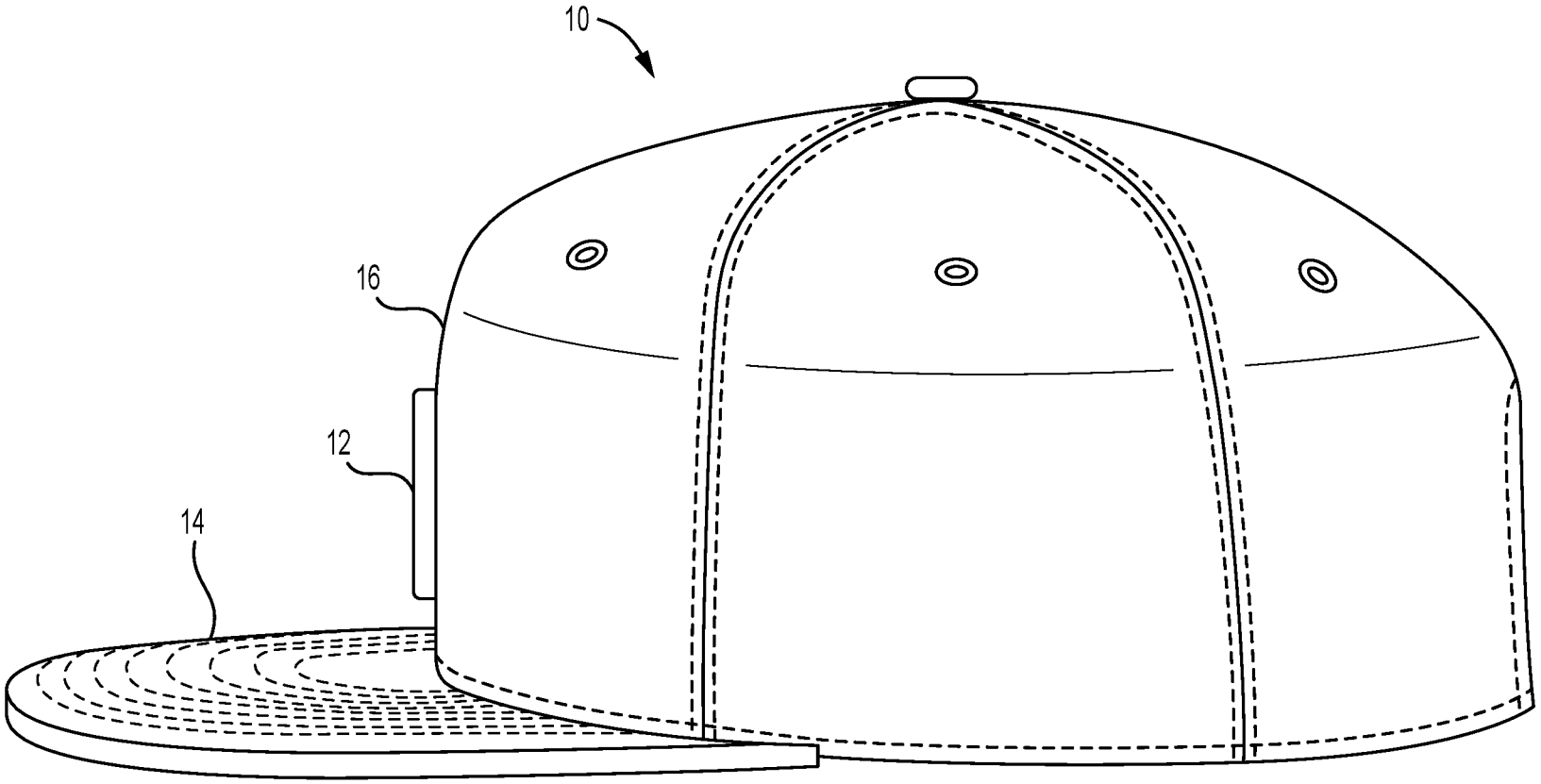
FIG. 2 shows a side view of a hat including a removable portion secured thereon according to one aspect of the present disclosure.

FIG. 1 and FIG. 2 show an aspect of a hat 10 featuring including a replaceable portion 12 located on the hat 10. The replaceable portion 12 may be a logo, emblem, or other decorative element that may be removably secured to the hat 10 as discussed in greater detail below. Suitable hats may include ball caps having a bill 14, as well as other various types of headwear including visors, bucket hats, beanies, and other various headwear.

The replaceable portion 12 may be a logo or emblem placed on the hat 10, such as on a front panel 16 of the hat 10. For example, the replaceable portion 12 may be placed at a center of the front panel 16 of the hat 10 such that the replaceable portion 12 is displayed on a front of the hat 10. However, it is also understood that aspects of the hat 10 described herein may include locating the replaceable portion 12 on other portions of the hat 10. For example, aspects may include locating the replaceable portion 12 along sides of the hat 10. Further, multiple of the replaceable portion 12 may be located on the hat 10, such as on the front panel 16 as well as sides of the hat 10.

Figure 3:
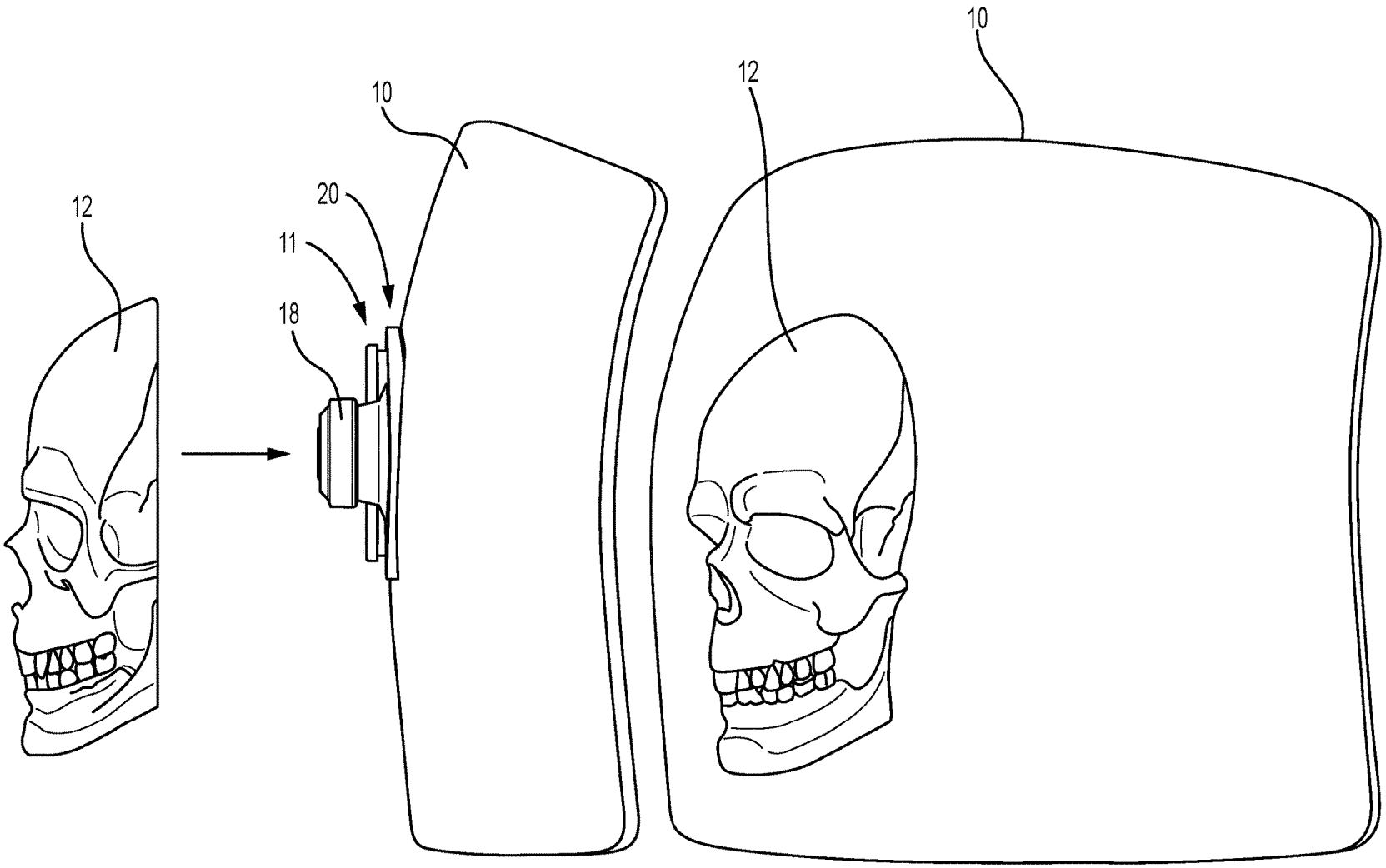
FIG. 3 shows a side view of a removable portion removably secured on a hat according to one aspect of the present disclosure.

Referring to FIG. 3, the hat 10 may include a fixed portion 11 having a male portion 18 on which the replaceable portion 12 is secured on the hat 10. The male portion 18 may be such that the replaceable portion 12 is securable on the male portion 18 with a snap-fit relationship.

Figure 4:
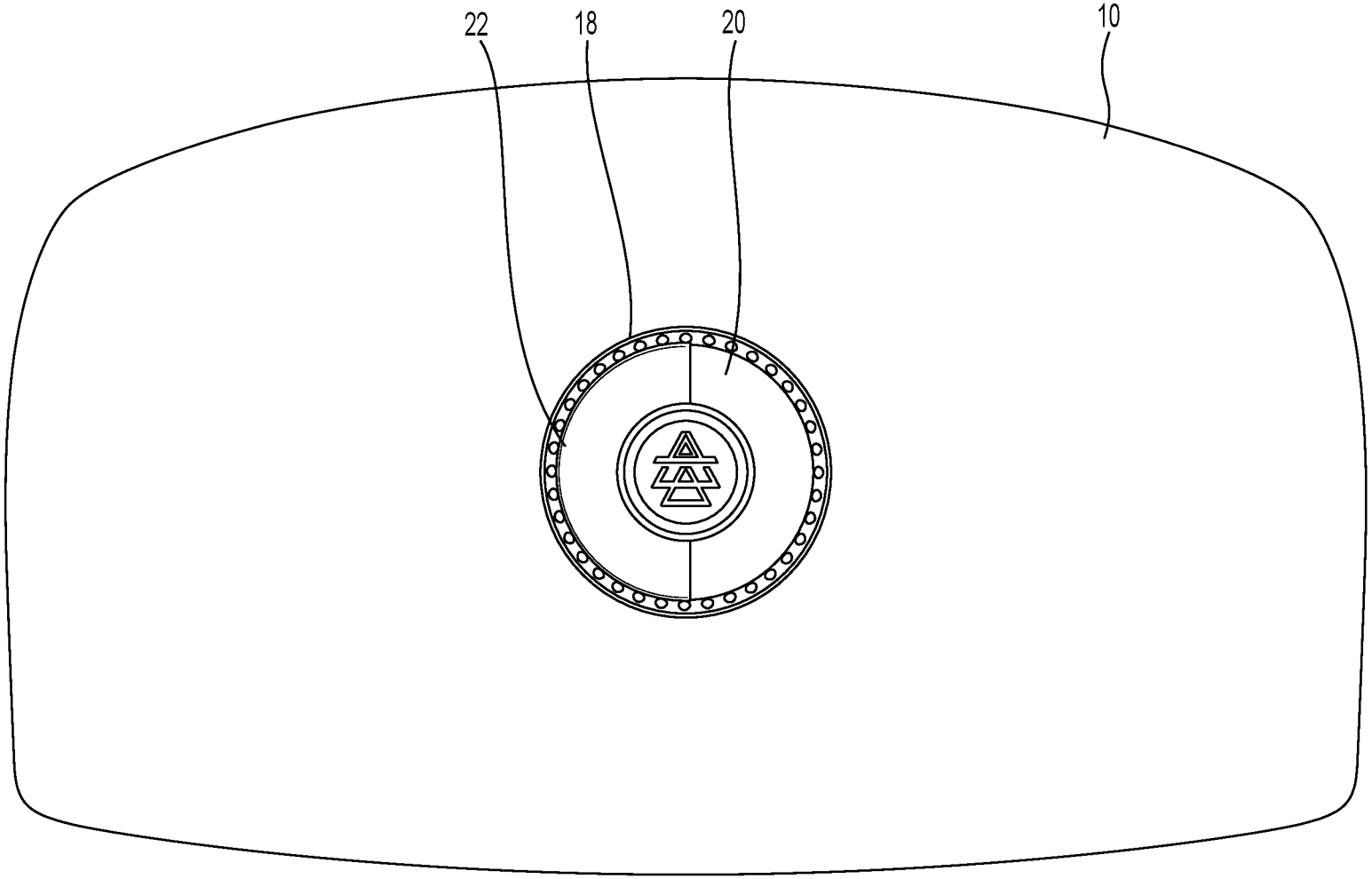
FIG. 4 shows a front view of a male portion attached to a hat according to one aspect of the present disclosure.

The fixed portion 11 may include a base 20 for securing the fixed portion 11 to the hat 10, as shown in FIG. 4. The base 20 of the fixed portion 11 includes a first surface 21 for abutting the portion of the hat 10 and a second surface 23 opposite and spaced apart from the first surface 21. The first surface 21 of the base 20 of the fixed portion 11 may be shaped such that the base 20 fits against or substantially conforms with a shape of the portion of the hat 10 on which the fixed portion 11 is attached. For example, the first surface 21 of the base 20 may have a concave surface for conforming to the curvature of the portion of the hat 10. The base 20 may be circular in shape, as shown in the figures. However, it is also understood that the base 20 may be formed in various other suitable shapes.

The base 20 may define a plurality of holes 22 extending through the base 20. The holes 22 may be spaced apart from each other along a perimetrical edge of the base 20 and may be shaped to receive stitching or other means of securing the base 20 to the hat 10.

Figure 5:
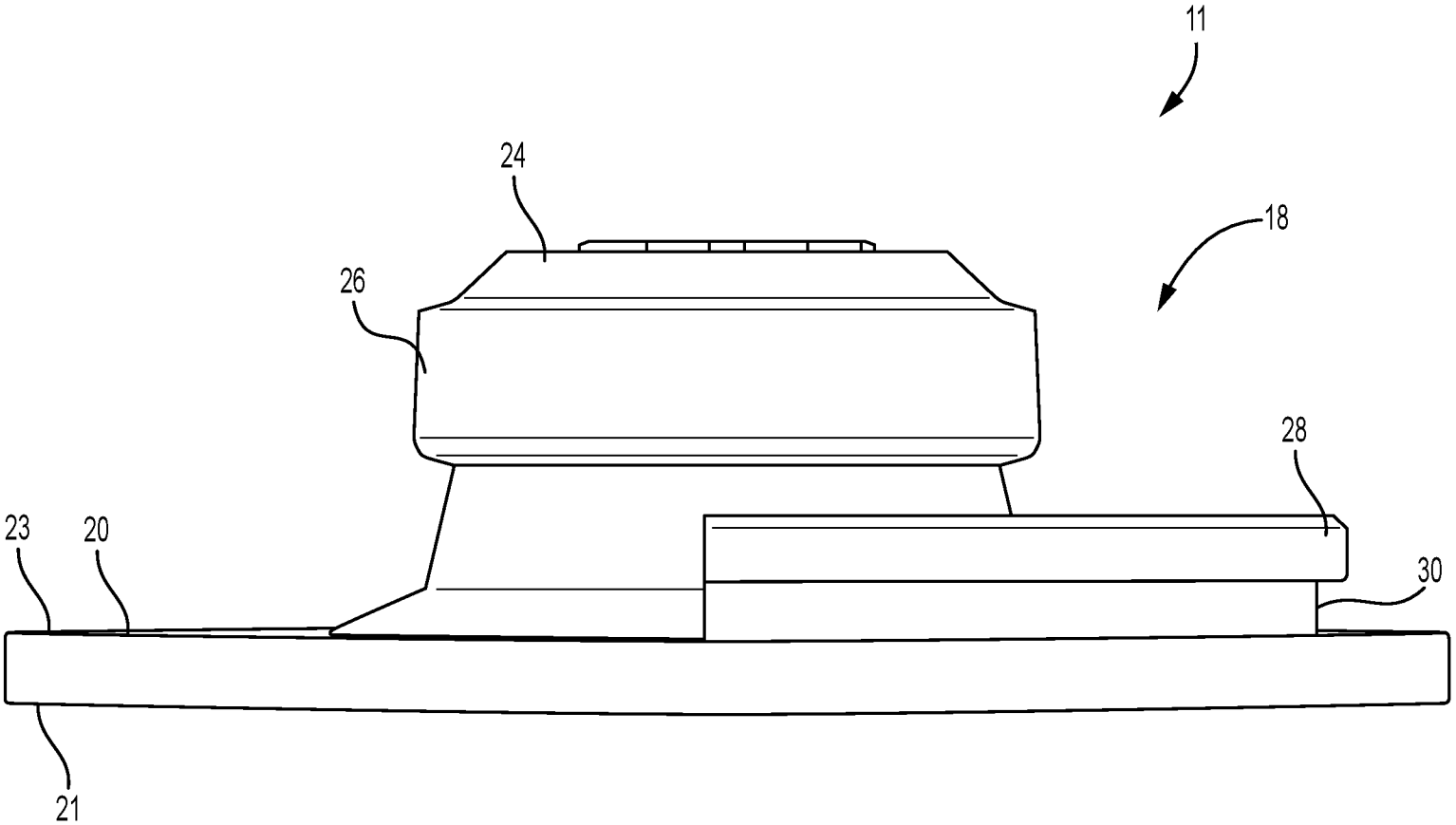
FIG. 5 shows a side view of a male portion according to one aspect of the present disclosure.
Figure 6:
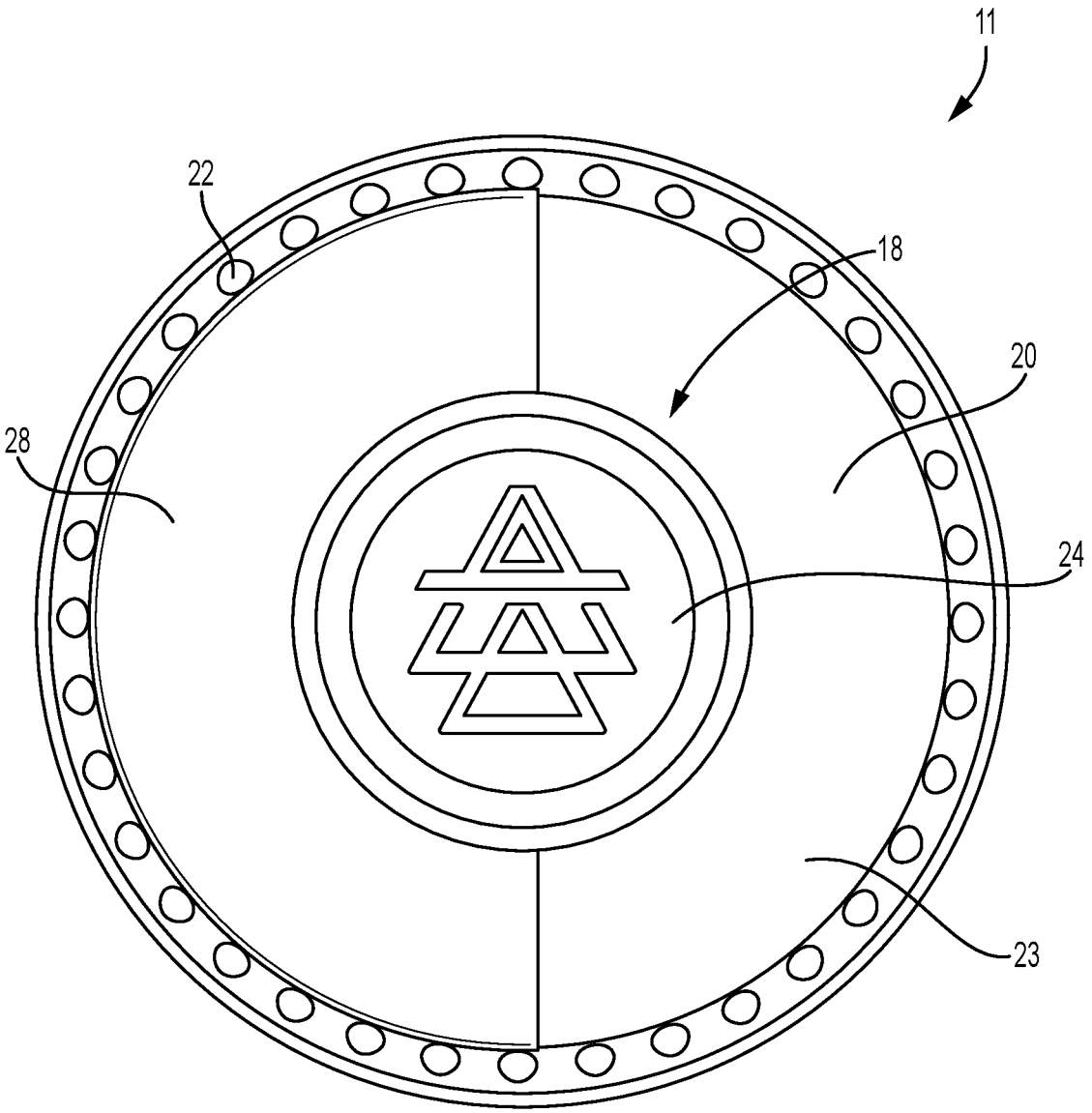
FIG. 6 shows a top view of a male portion according to one aspect of the present disclosure.

Referring now to FIG. 5 and FIG. 6, the male portion 18 of the fixed portion 11 includes a projection 24 extending from the second surface 23 of the base 20 of the fixed portion 11. The projection 24 includes a distal flared portion 26 extending circumferentially around the distal end of the projection 24. The distal flared portion 26 may be located on the projection 24 such that the distal flared portion 26 is spaced apart from the base 20.

Figure 7:
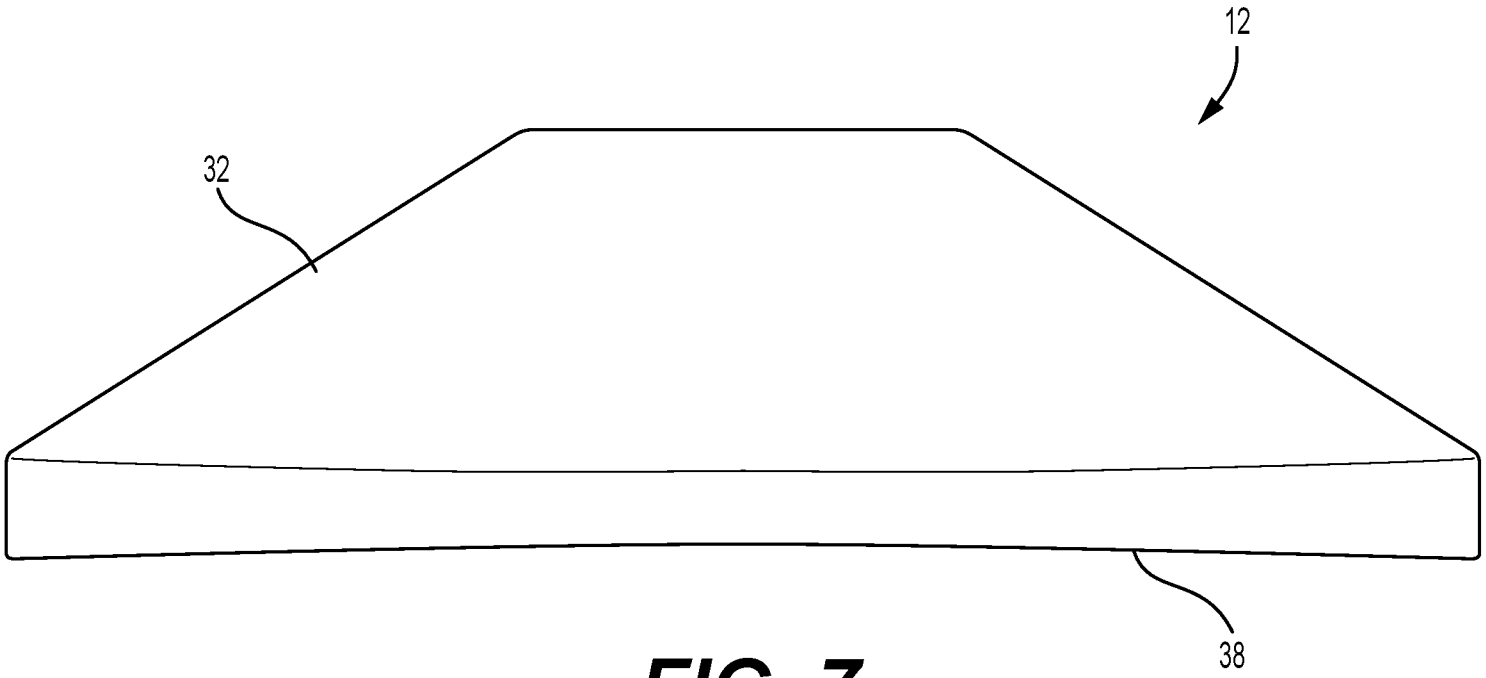
FIG. 7 shows a side view of a female portion according to one aspect of the present disclosure.
Figure 8:
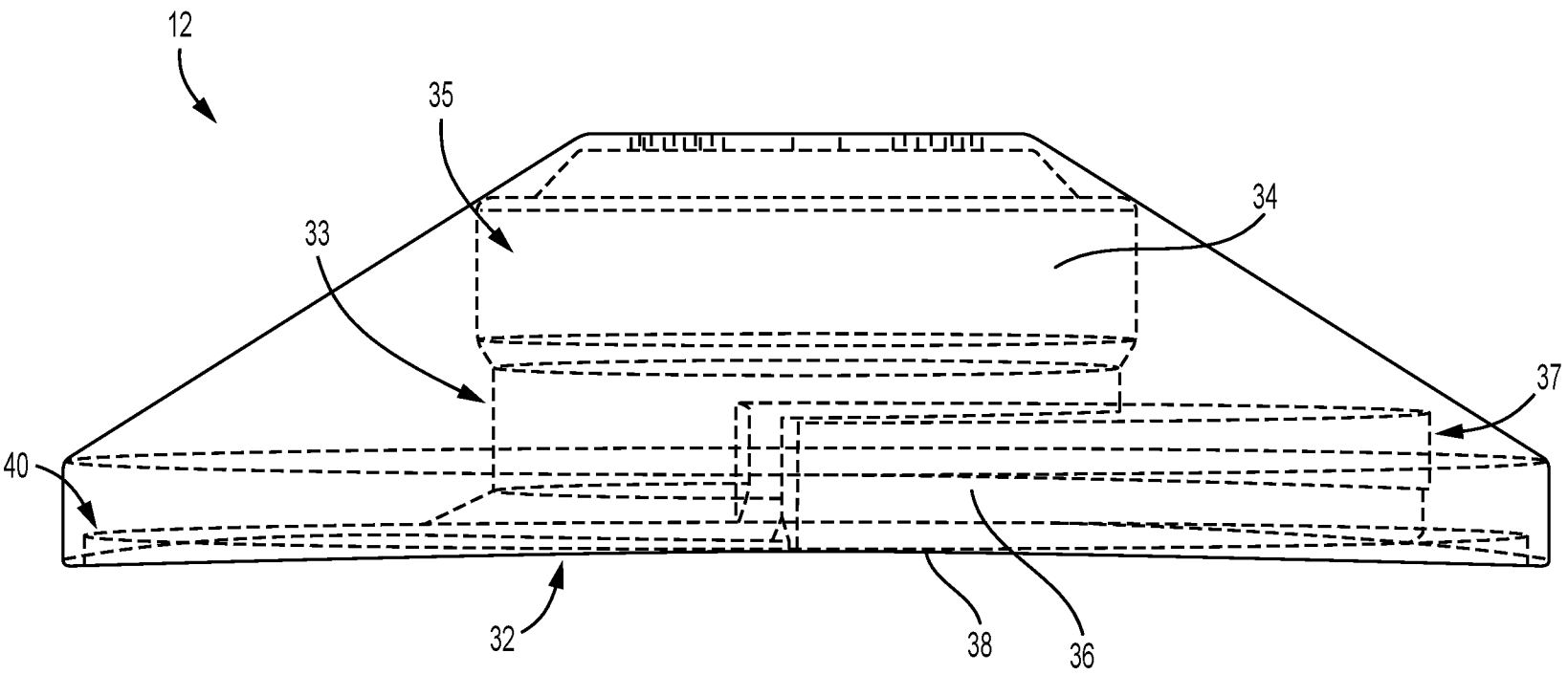
FIG. 8 shows an interior view of a female portion according to one aspect of the present disclosure.
Figure 9:
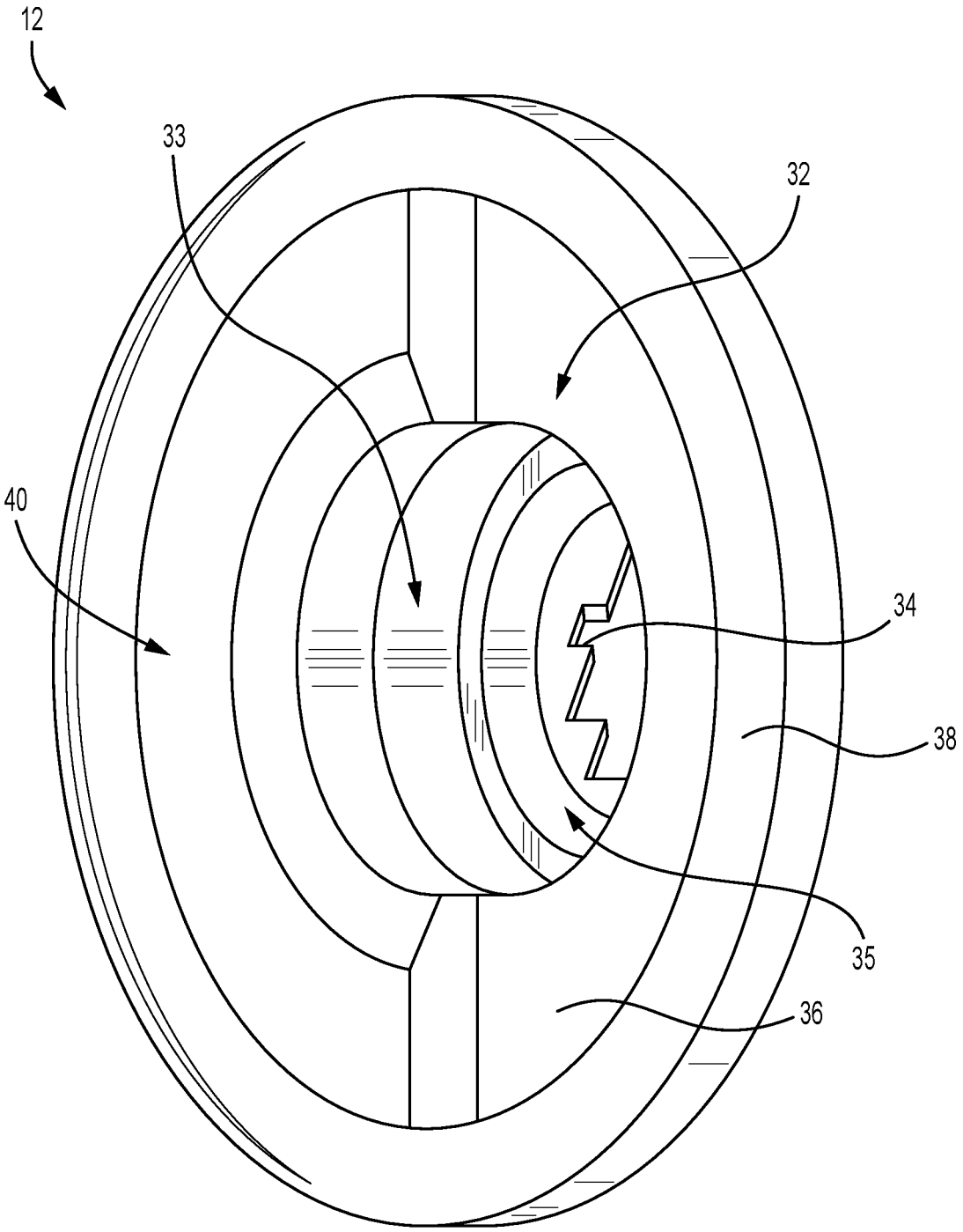
FIG. 9 shows a bottom view of a female portion according to one aspect of the present disclosure.

FIG. 7, FIG. 8, and FIG. 9 show a female portion 32 of the replaceable portion 12. The female portion 32 is on the replaceable portion 12 and is shaped to engage the male portion 18 in a snap-fit relationship. The female portion 32 may be formed as part of the replaceable portion 12, or the replaceable portion 12 may be attached to the female portion 32 for securing the replaceable portion 12 to the base 20 on the hat 10. The female portion 32 defines an interior portion 34 that is sized and shaped to receive the projection 24 of the male portion 18. The interior portion 34 is shaped to fit with the flared portion 26 of the projection 24 to removably couple and substantially retain the male portion 18 to the female portion 32.

The interior portion 34 of the female portion 32 defines a channel 33 adjacent the opening of the interior portion 34 and an interior portion groove 35 distal to the opening of the interior portion 34. The interior portion groove 35 is configured to receive the distal flared portion 26 when the replaceable portion 12 is coupled to the fixed portion 11. The distal flared portion 26 of the projection 24 is sized to be a friction fit with the channel 33 and the same or smaller sized than the interior portion groove 35. Thus, the distal flared portion 26 of the projection 24 or the side walls of the channel 33 must at least partially deform for the distal flared portion 26 to pass through the channel 33. Once through the channel 33, the distal flared portion 26 is disposed within the relatively larger interior portion groove 35. To decouple replaceable portion 12 from the fixed portion 11, enough force must be applied to the fixed portion 11 or the replaceable portion 12 to cause the distal flared portion 26 of the projection 24 or the side walls of the channel 33 to at least partially deform so that the distal flared portion 26 can pass back through the channel 33. This mechanism retains the male portion 18 within the female portion 32 when the replaceable portion 12 is coupled to the fixed portion 11.

Although the hat 10 shown in FIGS. 1-9 include a fixed portion 11 having a male portion 18 and a replaceable portion 12 having a female portion 32, in some implementations, the fixed portion may include the female portion and the replaceable portion may include the male portion.

The fixed portion 11 may further include a collar 28 on the base 20 that extends circumferentially at least partially around of the projection 24. For example, the collar 28 may extend circumferentially around half of the projection 24.

The female portion 32 may further define an indentation 36 located around a portion of the interior portion 34. The indentation 36 is shaped to conform to the collar 28 located around a portion of the male portion 18 to substantially prevent rotation of the replaceable portion 12 relative to the base 20 on the hat 10 when the replaceable portion 12 is secured on the hat 10. The collar 28 may be arranged in any way to retain the replaceable portion 12 in a desired orientation on the hat 10 when the replaceable portion 12 is secured on the male portion 18.

The collar 28 may further include a distal flange 30 formed around the collar 28 and spaced apart from the base 20. The indentation 36 can also include an indentation groove 37. The indentation groove 37 is configured to receive the distal flange 30 when the replaceable portion 12 is coupled to the fixed portion 11. This helps to retain the collar 28 within the indentation 36 during use.

In some implementations, the fixed portion may not include a collar but may include any other first locator or first orientation device. In some implementations, the replaceable portion may not define an indentation but may include any other second locator or second orientation device. In such implementations, the first locator or first orientation device is any mechanism configured to engage the second locator or second orientation device to prevent rotational movement of the replaceable portion relative to the fixed portion when the replaceable portion is coupled to the fixed portion. In some implementations, the fixed portion includes the indentation, second locator, or second orientation device, and the replaceable portion includes the collar, first locator, or first orientation device. In some implementations, the first locator or first orientation device is any protrusion configured to engage the indentation to prevent rotational movement of the replaceable portion relative to the fixed portion when the replaceable portion is coupled to the fixed portion. In some implementations, the device does not include a collar, first locator, or first orientation device and an indentation, second locator, or second orientation device.

The replaceable portion 12 may include a curved surface 38 located on a portion of the replaceable portion 12 that is positioned against the second surface 23 of the base 20 when the replaceable portion 12 is secured on the hat 10. For example, the second surface 23 of the base 20 of the fixed portion 11 may define a convex surface, and the replaceable portion 12 may define a concave portion 38 corresponding to the convex portion of the second surface 23 of the base 20. The convex surface may have a curvature that is substantially similar to the curvature of the portion of the hat 10 to which the base 20 is coupled. The curved surface 38 of the replaceable portion 12 may be curved such that the replaceable portion 12 fits substantially flush against the surface of the base 20. For example, the base 20 may be curved to conform to a shape of the front panel 16 of the hat 10. The curved surface 38 may be shaped to conform to the base 20 when the base 20 is located on the hat 10.

The replaceable portion 12 may also define a recess 40 along the surface configured to abut the base 20 when the replaceable portion 12 is coupled to the fixed portion 11. The recess 40 may be sized to fully or at least partially receive the base 20 of the fixed portion 11 within it. This allows the base 20 to be completely or at least partially hidden in use.

The replaceable portion 12 may be removably secured on the hat 10. Referring again to FIG. 3, the replaceable portion 12 including the female portion 32 maybe pressed onto the male portion 18. The projection 24 may fully fit within the interior portion 34 when the collar 28 of the male portion 18 is aligned with the indentation 36 of the female portion 32. When the replaceable portion 12 is located on the hat 10, the replaceable portion 12 is secured in a desired orientation. For example, when the replaceable portion 12 is an ornamental feature secured on the hat 10, the replaceable portion 12 may be secured in an upright orientation such that any ornamental feature of the replaceable portion 12 is properly displayed. The replaceable portion 12 may be readily removed by pulling the replaceable portion 12 from the hat 10 such that the male portion 18 disengages from the female portion 32.

In some implementations, the replaceable portion 12 may be a first replaceable portion 12 of a system, and the system may include a second replaceable portion 12, or three or more replaceable portions 12. For example, the second replaceable portion 12 may feature a different design or ornamental feature than the first replaceable portion 12 that a wearer desires to secure on the hat 10. Once the first replaceable portion 12 is decoupled from the fixed portion 11, the first replaceable portion 12 may be subsequently replaced by the second replaceable portion 12 such that the second replaceable portion 12 is removably coupled to the fixed portion 11 on the hat 10.

Although FIGS. 1-9 show the object to which the device is affixed being a hat 10, in some implementations, the object to which the device is affixed can be a shirt, pants, a shoe, a bag, luggage, a purse, an electronic device such as a computer, tablet, or phone, a dish such as a cup, or any other object to which a user may want to affix an ornamental piece.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A device for affixing an ornamental piece to an object, the device comprising:

a fixed portion configured to be attached to a portion of the object, the fixed portion including a base, wherein the base of the fixed portion includes a first surface for abutting the portion of the object and a second surface opposite and spaced apart from the first surface, wherein the first surface has a concave surface for conforming to the curvature of the portion of the object, and wherein the second surface has a convex surface substantially similar to the curvature of the object, wherein the projection extends from the second surface, and one of a male portion including a projection or a female portion defining an interior portion; and a replaceable portion including an other of the female portion defining the interior portion or the male portion including the projection, wherein the interior portion of the female portion is shaped to receive the projection of the male portion to removably couple the replaceable portion to the male-fixed portion, wherein the projection of the male portion includes a distal flared portion, wherein the interior portion of the female portion defines a channel and an interior portion groove, wherein the interior portion groove is configured to receive the flared portion when the replaceable portion is coupled to the fixed portion, and wherein the flared portion of the projection is sized to be a friction fit with the channel and the same or smaller sized than the interior portion groove to retain the replaceable portion when the replaceable portion is coupled to the fixed portion.

2. The device of claim 1, wherein the fixed portion includes a first orientation device and the replaceable portion includes a second orientation device, wherein the first orientation device is configured to prevent rotational movement of the replaceable portion relative to the fixed portion when the replaceable portion is coupled to the fixed portion.

3. The device of claim 2, wherein one of the first orientation device and the second orientation device includes a protrusion and an other of the second orientation device and the first orientation device defines an indentation, wherein the indentation is configured to receive the protrusion.

4. The device of claim 3, wherein the protrusion includes a collar extending circumferentially at least partially around the projection or the interior portion.

5. The device of claim 3, wherein the protrusion includes a distal flange and the indentation includes an indentation groove, wherein the indentation groove is configured to receive the distal flange when the replaceable portion is coupled to the fixed portion.

6. The device of claim 1, wherein the distal flared portion of the projection or the side walls of the channel must at least partially deform for the distal flared portion to pass through the channel.

7. The device of claim 6, wherein the flared portion of the projection is sized to be a friction fit with the channel and the same or smaller sized than the interior portion groove to retain the replaceable portion when the replaceable portion is coupled to the fixed portion.

8. The device of claim 1, wherein the fixed portion includes the male portion and the replaceable portion includes the female portion.

9. The device of claim 1, wherein the base of the fixed portion defines a plurality of holes extending through the base, wherein the plurality of holes are spaced apart from each other adjacent a perimetrical edge of the base.

10. The device of claim 1, wherein the object is a hat.

11. The device of claim 1, wherein the replaceable portion defines a recess for receiving the base of the fixed portion.

12. The device of claim 1, wherein the base of the fixed portion includes a first surface for abutting the portion of the object and a second surface opposite and spaced apart from the first surface, wherein the projection extends from the second surface, wherein the first surface has a concave surface for conforming to the curvature of the portion of the object.

13. The device of claim 12, wherein the second surface has a convex surface substantially similar to the curvature of the object.

14. A system for affixing ornamental pieces to an object, the system comprising:

a fixed portion configured to be attached to a portion of an object, the fixed portion including a base, wherein the base of the fixed portion includes a first surface for abutting the portion of the object and a second surface opposite and spaced apart from the first surface, wherein the first surface has a concave surface for conforming to the curvature of the portion of the object, and wherein the second surface has a convex surface substantially similar to the curvature of the object, wherein the projection extends from the second surface, and one of a male portion including a projection or a female portion defining an interior portion; and a first replaceable portion and a second replaceable portion, wherein each of the first replaceable portion and the second replaceable portion include an other of the female portion defining the interior portion or the male portion including the projection, wherein the interior portion of the female portion is shaped to receive the projection of the male portion to removably couple the first replaceable portion or the second replaceable portion to the fixed portion, wherein the projection of the male portion includes a distal flared portion, wherein the interior portion of the female portion defines a channel and an interior portion groove, wherein the interior portion groove is configured to receive the flared portion when the first replaceable portion or the second replaceable portion is coupled to the fixed portion, and wherein the flared portion of the projection is sized to be a friction fit with the channel and the same or smaller sized than the interior portion groove to retain the first replaceable portion or the second replaceable portion when the first replaceable portion or the second replaceable portion is coupled to the fixed portion.

15. The system of claim 14, wherein the fixed portion includes a first orientation device and the first replaceable portion and the second replaceable portion each include a second orientation device, wherein the first orientation device is configured to prevent rotational movement of the first replaceable portion or the second replaceable portion relative to the fixed portion when the first replaceable portion or the second replaceable portion.

16. The system of claim 15, wherein one of the first orientation device and the second orientation device includes a collar extending circumferentially at least partially around the projection or the interior portion and an other of the second orientation device and the first orientation device defines an indentation, wherein the indentation is configured to receive the protrusion.

17. The system of claim 14, wherein the distal flared portion of the projection or the side walls of the channel must at least partially deform for the distal flared portion to pass through the channel.

18. The system of claim 17, wherein the flared portion of the projection is sized to be a friction fit with the channel and the same or smaller sized than the interior portion groove to retain the first replaceable portion or the second replaceable portion when the first replaceable portion or the second replaceable portion.

19. The system of claim 14, wherein the fixed portion includes the male portion and the first replaceable portion or the second replaceable portion each include the female portion.

20. The system of claim 14, wherein the base of the fixed portion defines a plurality of holes extending through the base.

* * * * *